US007077676B2

(12) United States Patent
Matsumoto et al.

(10) Patent No.: US 7,077,676 B2
(45) Date of Patent: Jul. 18, 2006

(54) CONNECTOR WITH LIQUID INTRUSION PREVENTION STRUCTURE

(75) Inventors: Mitsuhiro Matsumoto, Shizuoka (JP); Hirotaka Fukushima, Shizuoka (JP); Takashi Tsukamoto, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 11/230,741

(22) Filed: Sep. 21, 2005

(65) Prior Publication Data

US 2006/0063412 A1 Mar. 23, 2006

(30) Foreign Application Priority Data

Sep. 21, 2004 (JP) ..... P2004-273389

(51) Int. Cl.
*H01R 13/52* (2006.01)

(52) U.S. Cl. ..... 439/271

(58) Field of Classification Search ..... 439/271, 439/272, 274, 275, 587
See application file for complete search history.

(56) References Cited

U.S. PATENT DOCUMENTS 4,859,200 A * 8/1989 McIntosh et al. ..... 439/275
5,567,170 A * 10/1996 Kroeber ..... 439/186
6,152,745 A * 11/2000 Matsumoto et al. ..... 439/98
6,203,354 B1 * 3/2001 Kuwahara et al. ..... 439/357
6,341,884 B1 * 1/2002 Leleve et al. ..... 362/514
6,383,021 B1 * 5/2002 Murakami et al. ..... 439/587
6,616,480 B1 * 9/2003 Kameyama ..... 439/587
6,817,888 B1 * 11/2004 Kozono et al. ..... 439/468

FOREIGN PATENT DOCUMENTS

JP 2003-109702 A 4/2003

* cited by examiner

*Primary Examiner*—Tulsidas C. Patel
*Assistant Examiner*—Harshad C Patel
(74) *Attorney, Agent, or Firm*—Sughrue Mion, PLLC

(57) ABSTRACT

A male tab terminal has an O-ring mounting portion formed between its wire connection portion and its electrical contact portion, and this O-ring mounting portion is surrounded by an opening peripheral surface of an O-ring receiving step portion of a female connector housing which defines an opening of a male terminal receiving chamber. An O-ring, mounted on the O-ring mounting portion of the male tab terminal, is held in intimate contact with an outer peripheral surface of the O-ring mounting portion over an entire periphery thereof, and also is held in intimate contact with the opening peripheral surface of the O-ring receiving step portion over an entire periphery thereof. When a female connector and a male connector are fitted together, the O-ring is directly clamped between the female connector housing and a male connector housing in a direction of fitting of the female and male connectors, and is pressed by the two connector housings.

7 Claims, 10 Drawing Sheets

CONNECTOR WITH LIQUID INTRUSION PREVENTION STRUCTURE

BACKGROUND OF THE INVENTION

1. Field of the Invention

This invention relates to a connector having a structure for preventing a liquid such as water and oil form intruding into a terminal receiving chamber in a connector housing.

2. Related Art

There is known one conventional connector with a liquid intrusion prevention structure (which has been marketed by YAZAKI Parts Co., Ltd.), in which a silicone filler is filled in each male terminal receiving chamber which is formed in a connector housing, and receives a male tab terminal (male terminal). This connector is shown in FIGS. 9, 10 and 11. As shown in FIGS. 9, 10 and 11, the connector 50 (which is a male connector) includes the male connector housing 51 having the male terminal receiving chambers 52 formed therein.

Each male tab terminal 53, electrically connected at its wire connection portion 71 to a wire 70, is received in the corresponding male terminal receiving chamber 52 such that its electrical contact portion 72 projects outwardly from the male connector housing 51. The silicone filler 54 is filled in the male terminal receiving chamber 52, and a waterproof rubber plug 55 of an annular shape is inserted between an opening peripheral surface of the male connector housing 51 (which defines a rear opening (with respect to a connector fitting direction) of the male terminal receiving chamber 52) and the wire 70, thereby sealing the male terminal receiving chamber 52.

Therefore, the silicone filler 54 prevents a liquid, such as water and oil, from intruding into the male connector housing 51 from that side where the electrical contact portion 72 of the male tab terminal 53 is disposed, and also the waterproof rubber plug 55 also prevents a liquid, such as water and oil, from intruding into the male connector housing 51 from that side where the wire 70 is disposed.

In the above connector 50, however, it is necessary to use a special-purpose machine for pouring the silicone filler 54 into the male terminal receiving chamber 52, and besides time and labor are required for operating this special-purpose machine, and therefore this is disadvantageous from the viewpoint of the cost.

Furthermore, generally, the silicone filler 54 has high viscosity, and therefore in order to ensure the smooth pouring, the connector must be so designed as to provide a relatively large gap within the male terminal receiving chamber 52. Therefore, when the amount of pouring of the silicone filler 54 into the male terminal receiving chamber 52 is small, the male tab terminal 53 is liable to considerably shake relative to the male connector housing 51. And besides, when the connector 50 is to be used in a vehicle such as an automobile, the silicone filler 54 must be effectively filled in a gap within the male terminal receiving chamber 52 so that the connector 50 can withstand vibrations.

Generally, the adhesion of the silicone filler 54 is liable to be broken by a so-called thermal shock due to an abrupt change in the ambient temperature, and various measures must be taken in order to maintain the initial liquid intrusion prevention performance of the connector 50 for a long period of time.

There is known another connector having a liquid intrusion prevention structure different from that of the above connector 50 (see, for example, JP-A-2003-109702 (FIGS. 1 to 3)). In the connector (an oil/water-proof terminal structure) disclosed in JP-A-2003-109702, a tubular elastic seal member (rubber packing) is mounted on a male tab terminal (metal terminal), and this elastic seal member is held in intimate contact with an inner surface of a male connector housing and the male tab terminal within a male terminal receiving chamber, thereby preventing a liquid, such as water and oil, from intruding into the male terminal receiving chamber from that side where an electrical contact portion of the male tab terminal is disposed. The connector, disclosed in JP-A-2003-109702, can perfectly eliminate the drawbacks encountered with the pouring of the silicone filler 54 in the connector 50.

However, the above elastic seal member is made 100 percent of rubber (usually, synthetic rubber), and in the liquid intrusion prevention structure in which the 100% rubber-made elastic seal member is merely clamped between the male connector housing and the male tab terminal, there is a high possibility that the shaking of the male tab terminal relative to the male connector housing occurs due to aged deterioration such as contraction of the rubber material forming the elastic seal member, so that the liquid intrusion prevention performance is lowered. In addition, when assembling the connector disclosed in JP-A-2003-109702, the male tab terminal, having the long tubular elastic seal member mounted thereon, must be pushed into the male connector housing, and therefore the assembling operation is difficult, and besides there is a possibility that the male tab terminal is bent by this pushing force.

SUMMARY OF THE INVENTION

This invention has been made in view of the above circumstances, and an object of the invention is to provide a connector with a liquid intrusion prevention structure which can reduce adverse effects on a terminal shaking prevention performance and a liquid intrusion prevention performance due to aged deterioration of an elastic seal member, and also can be assembled easily.

The above object has been achieved by a connector of the present invention having features recited in the following Paragraphs (1), (2), (3), (4), (5), (6) and (7).

(1) A connector comprising a female connector, and a male connector for fitting to the female connector, wherein one of the female and male connectors includes:

a connector housing;

a male terminal receiving chamber formed in the connector housing;

a male terminal including a wire connection portion for electrical connection to a wire, and an electrical contact portion which is electrically connected to a female terminal in the other of the female and male connectors when the female and male connectors are fitted together, the male terminal being received in the male terminal receiving chamber such that the electrical contact portion of the male terminal projects outwardly from the male terminal receiving chamber through an opening of the male terminal receiving chamber;

a receiving step portion which is formed in the connector housing, and has an opening peripheral surface defining the opening;

a mounting portion which is formed on the male terminal, and is disposed between the wire connection portion and the electrical contact portion, and is surrounded by the opening peripheral surface of the receiving step portion; and an annular elastic seal member which is clamped between the mounting portion of the male terminal and the opening peripheral surface of the receiving step portion; and the elastic seal member is held in intimate contact with an outer peripheral surface of the mounting portion over an entire periphery thereof, and also is held in intimate contact with the opening peripheral surface of the receiving step portion over an entire periphery thereof, and when the female connector and the male connector are fitted together, the elastic seal member is directly clamped between the connector housing and a connector housing of the other connector, receiving the female terminal, in a direction of fitting of the female and male connectors, and is pressed by the two connector housings.

(2) The connector of the construction of the above Paragraph (1), wherein when the female connector and the male connector are fitted together, the elastic seal member is directly pressed by a peripheral surface of the opening peripheral surface of the receiving step portion (which is disposed close to the male terminal receiving chamber, and intersects a direction of extending of the electrical contact portion of the male terminal) and a portion of a front surface (with respect to the fitting direction) of the connector housing of the other connector, and the portion is disposed around a male terminal insertion port (which allows the female terminal and the electrical contact portion of the male terminal to contact each other) formed in the front surface.

(3) The connector of the construction of the above Paragraph (1) or Paragraph (2), wherein the outer peripheral surface of the mounting portion has curved surface portions.

(4) The connector of the construction of any one of the above Paragraphs (1) to (3), wherein the mounting portion has generally U-shaped grooves, and the elastic seal member is fitted in the U-shaped grooves, and is retained by the grooves.

(5) The connector of the construction of the above Paragraph (4), wherein a bottom surface of each of the U-shaped grooves in the mounting portion defines the curved surface portion.

(6) The connector of the construction of any one of the above Paragraphs (1) to (5), wherein the elastic seal member is an O-ring made of rubber.

(7) The connector of the construction of any one of the above Paragraphs (1) to (6), wherein a waterproof plug is disposed between the wire, connected to the wire connection portion of the male terminal, and the connector housing of the one connector, and the waterproof plug and the elastic seal member cooperate with each other to make the male terminal receiving chamber watertight.

In the connector of the construction of the above Paragraph (1), the annular seal member is held in intimate contact with the outer peripheral surface of the mounting portion of the male terminal over the entire periphery thereof, and also is held in intimate contact with the opening peripheral surface of the receiving step portion (which defines the opening through which the electrical contact portion of the male terminal projects outwardly from the male terminal receiving chamber) of the connector housing over the entire periphery thereof, and when the female connector and the male connector are fitted together, the elastic seal member is directly clamped between the connector housing of the one connector and the connector housing of the other connector in the direction of fitting of the female and male connectors, and is pressed by the two connector housings. Therefore, unlike the type of liquid intrusion prevention structure in which the elastic seal member is mounted on the male terminal, and is merely clamped between the male terminal and the connector housing, the liquid intrusion prevention structure of the invention is such that the elastic seal member is pressed by the two connector housings in the direction of fitting of the female and male connectors, so that the degree of intimate contact of the elastic seal member with the outer peripheral surface of the mounting portion of the male terminal, as well as the degree of intimate contact of the elastic seal member with the opening peripheral surface of the receiving step portion, is enhanced. Therefore, the elastic seal member positively prevents a liquid such as water and oil from intruding into the male terminal receiving chamber from that side where the electrical contact portion of the male terminal is disposed. Thus, the degree of intimate contact of the elastic seal member with the outer peripheral surface of the mounting portion of the male terminal, as well as the degree of intimate contact of the elastic seal member with the opening peripheral surface of the receiving step portion, is enhanced by the elastic deformation of the elastic seal member in the fitting direction which is caused by the pressing of the connector housings of the female and male connectors against the elastic seal member. Therefore, adverse effects on the terminal shaking prevention performance and the liquid intrusion prevention performance due to aged deterioration of the elastic seal member can be reduced.

The term "the elastic seal member is held in intimate contact with the outer peripheral surface of the mounting portion over the entire periphery thereof" means that the elastic seal member extends completely around the outer peripheral surface of the mounting portion, but the elastic seal member may or may not be held in intimate contact with the outer peripheral surface of the mounting portion over the entire area thereof. Similarly, the term "the elastic seal member is held in intimate contact with the opening peripheral surface of the receiving step portion over the entire periphery thereof" means that the elastic seal member extends completely along the opening peripheral surface of the receiving step portion, but the elastic seal member may or may not be held in intimate contact with the opening peripheral surface of the receiving step portion over the entire area thereof. Naturally, it is preferred that the area of intimate contact of the elastic seal member with the outer peripheral surface of the mounting portion, as well as the area of intimate contact of the elastic seal member with the opening peripheral surface of the receiving step portion, be larger.

In the connector of the construction of the above Paragraph (2), when the female connector and the male connector are fitted together, the elastic seal member is directly pressed by the peripheral surface of the opening peripheral surface of the receiving step portion (which is disposed close to the male terminal receiving chamber, and intersects the direction of extending of the electrical contact portion of the male terminal) and the portion of the front surface (with respect to the fitting direction) of the connector housing of the other connector, and this portion is disposed around the male terminal insertion port (which allows the female terminal and the electrical contact portion of the male terminal to contact each other) formed in the front surface of the connector housing of the other connector. Therefore, the elastic seal member also positively prevents a liquid such as water and oil from intruding into the connector housing of the other connector through the male terminal insertion port. And besides, the elastic seal member is exposed to the exterior of the connector housing of the one connector through the front side thereof, and is disposed in such a position that the elastic seal member can be brought into contact with the connector housing of the other connector when the connector housing of the one connector is fitted to the connector housing of the other connector. Therefore, the elastic seal member can be easily mounted on the mounting portion from the electrical contact portion side of the male terminal, and therefore the liquid intrusion prevention structure can be easily assembled.

In the connector of the construction of the above Paragraph (3), the elastic seal member can be held in intimate contact with the curved surface portions of the mounting portion in a tense condition as compared with the case where edges (or corners) are formed on the mounting portion. And besides, the elastic seal member is protected from damage by such edges. Thus, the mounting portion is not a flat plate-shaped portion having four corners or such a portion whose four corners are merely chamfered, but has the curved surfaces, and therefore achieves the excellent advantageous effects.

In the connector of the construction of the above Paragraph (4), the elastic seal member is fitted in the U-shaped grooves, and is retained by these grooves. Therefore, the elastic seal member will not be disengaged from the mounting portion, and also will not be displaced out of position.

Preferably, the bottom surface of the U-shaped groove defines the curved surface portion as in the connector of the construction of the above Paragraph (5).

Preferably, the elastic seal member is the O-ring made of the rubber as in the connector of the construction of the above Paragraph (6). The O-ring is made of a soft synthetic resin, and is formed into an annular shape, and the O-ring performs the sealing function by its elastic restoring force produced when it is gripped and squeezed.

In the connector of the construction of the above Paragraph (7), the waterproof plug prevents a liquid such as water and oil from intruding into the connector housing from that side where the wire is disposed, and therefore this construction is preferred.

In the present invention, there can be provided the connector with the liquid intrusion prevention structure which can reduce adverse effects on the terminal shaking prevention performance and the liquid intrusion prevention performance due to aged deterioration of the elastic seal member, and also can be assembled easily.

The present invention has been briefly described above. Details of the invention will become manifest upon reading the following Section "DETAILED DESCRIPTION OF THE PREFERRED EMBODIMENTS" with respect to the accompanying drawings.

DETAILED DESCRIPTION OF THE PREFERRED EMBODIMENTS

A preferred embodiment of the present invention will now be described in detail with reference to the drawings.

Figure 1:
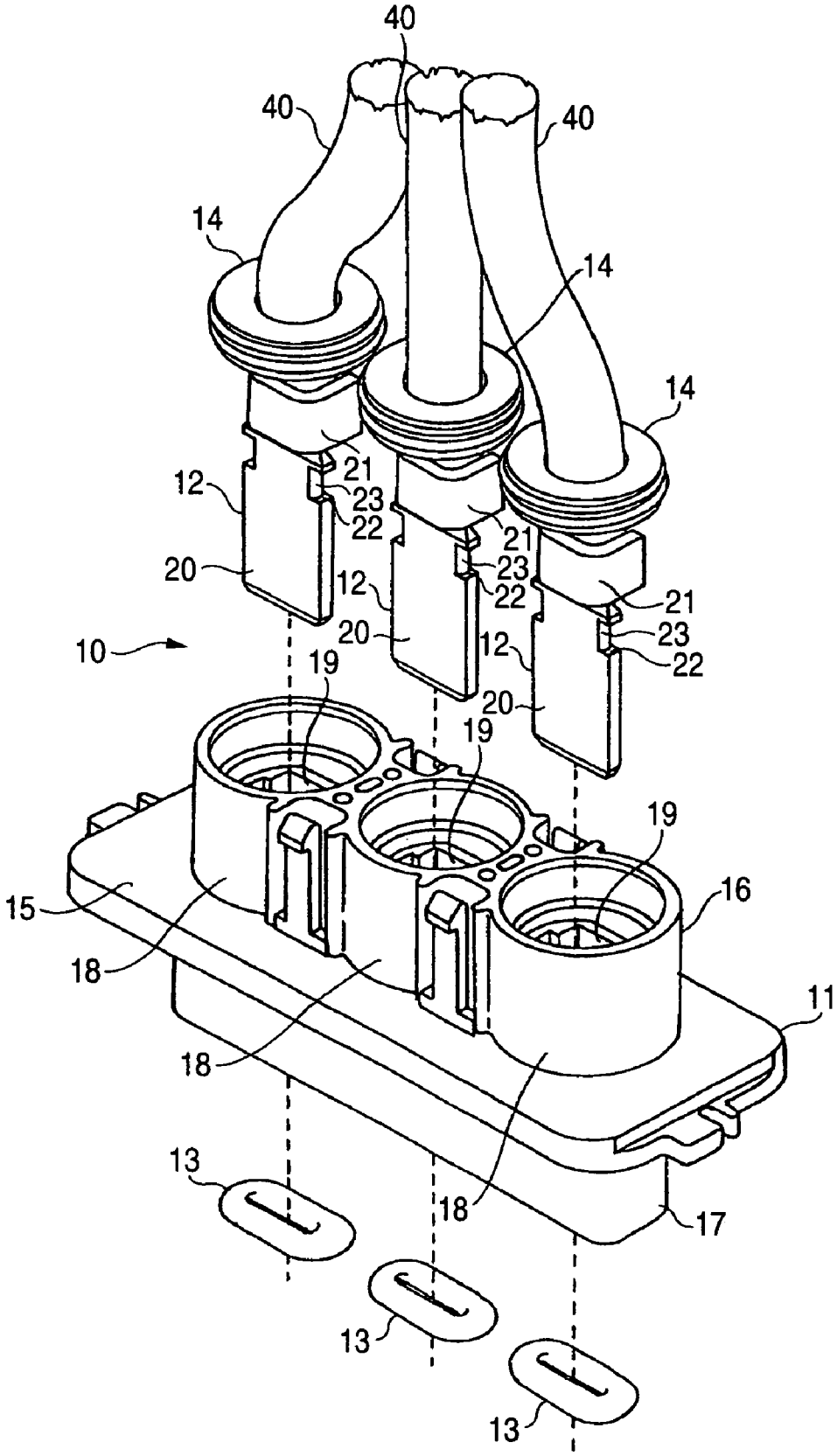
FIG. 1 is an exploded, perspective view showing the assembling relation between various parts of a female connector of one preferred embodiment of a connector of the present invention.
Figure 2:
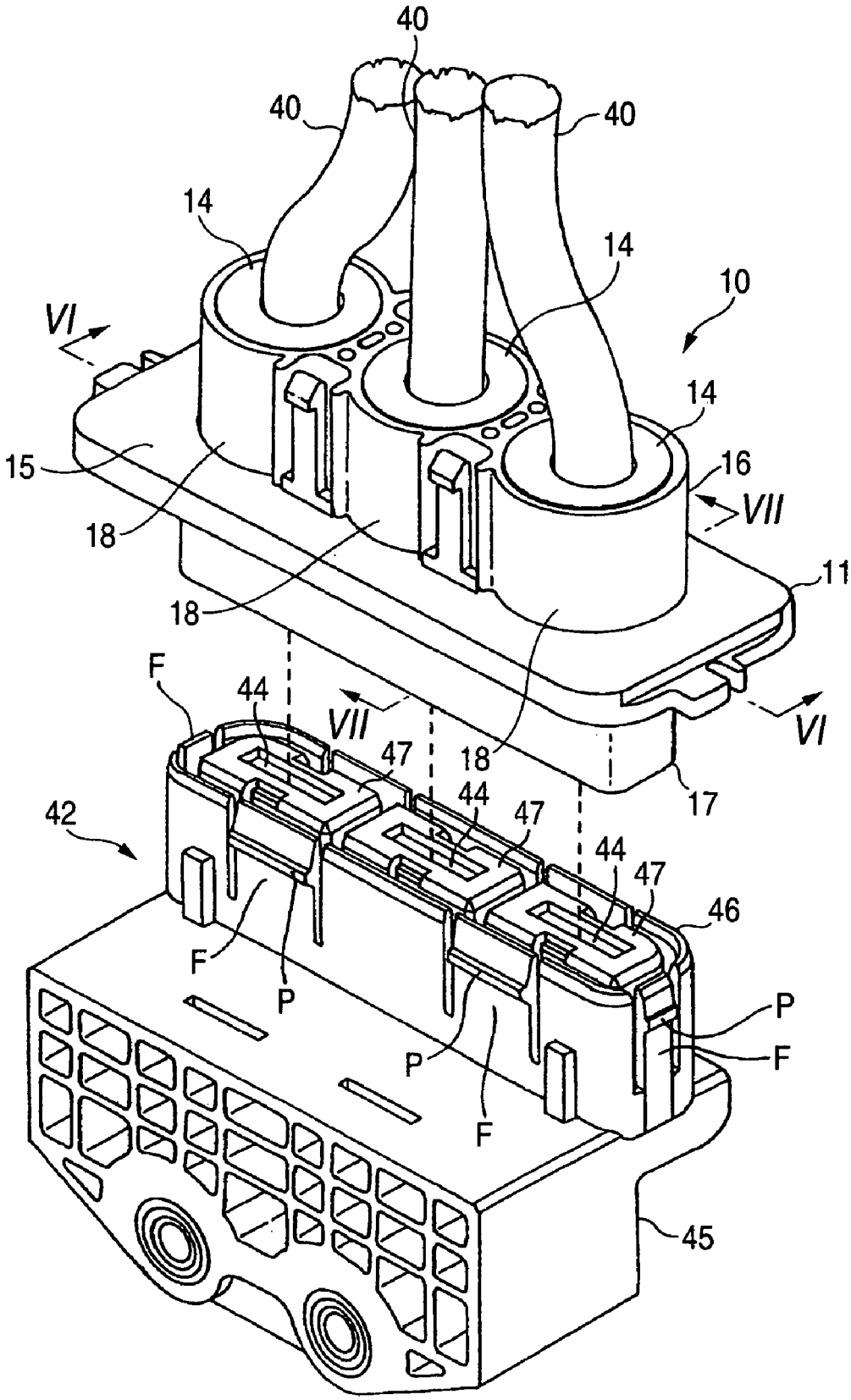
FIG. 2 is a perspective view showing a condition immediately before the assembled female connector of FIG. 1 and a male connector are fitted together.
Figure 3A:
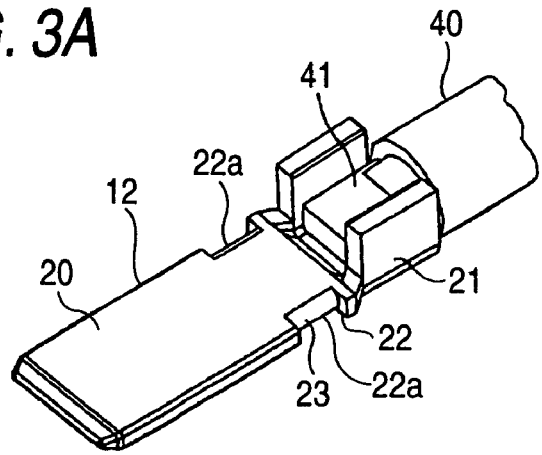
FIG. 3A is a perspective view showing a male tab terminal (which is to be received in a male terminal receiving chamber in a connector housing of the female connector of FIG. 1) and a wire connected to the male tab terminal.
Figure 3B:
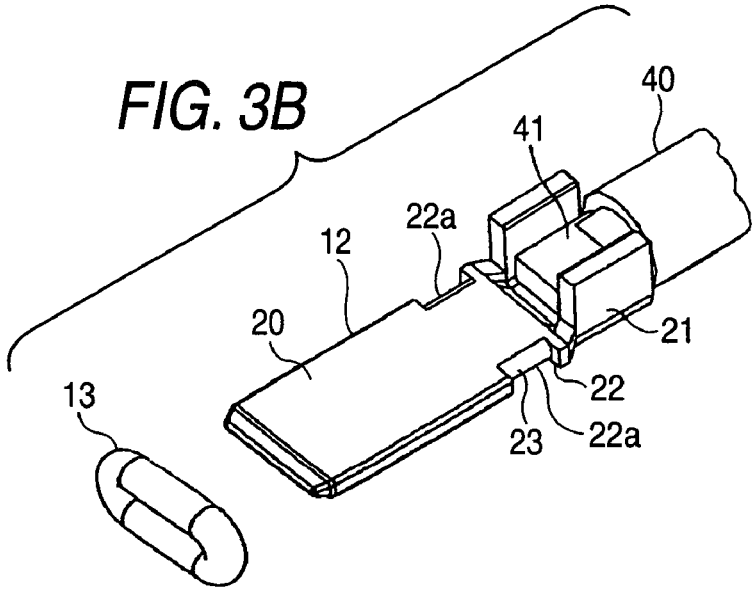
FIG. 3B is a perspective view showing a condition before an elastic seal member is mounted on the wire-connected male tab terminal of FIG. 3A.
Figure 3C:
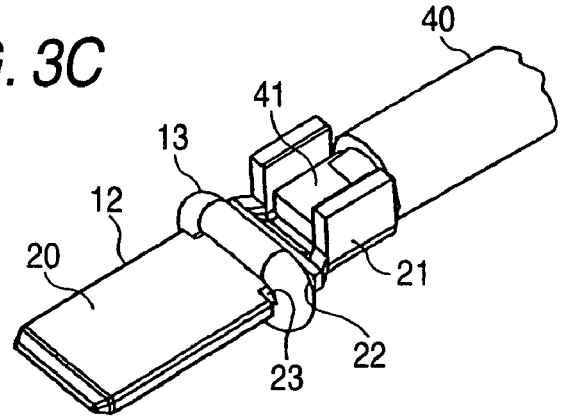
FIG. 3C is a perspective view of the wire-connected male tab terminal having the elastic seal member of FIG. 3B mounted thereon.
Figure 4:
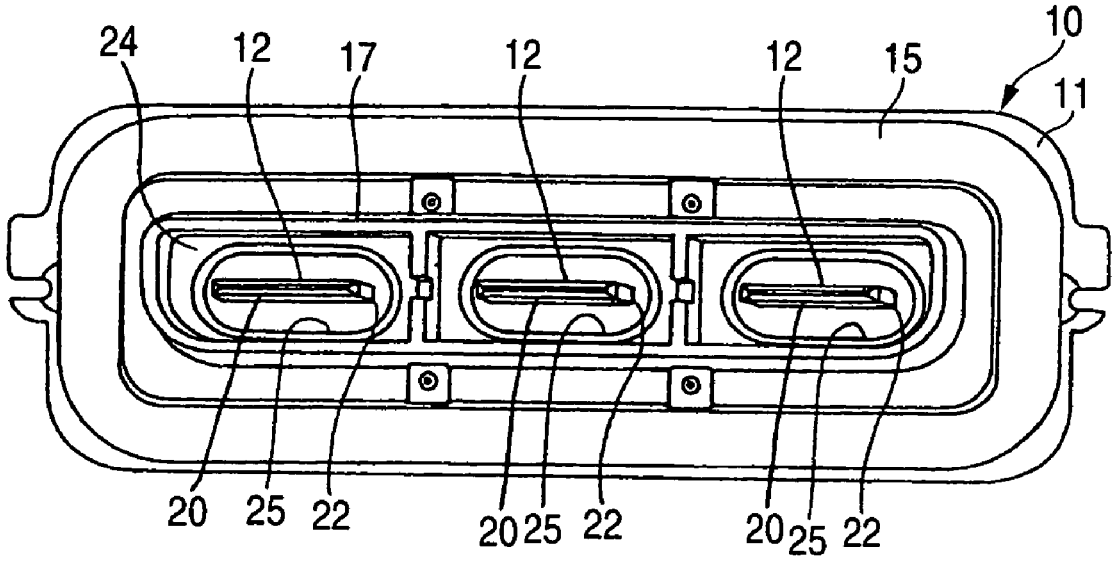
FIG. 4 is a perspective view of a fitting portion of the female connector (in which the elastic seal members are not yet mounted) for the male connector as seen obliquely from the lower left side.
Figure 5:
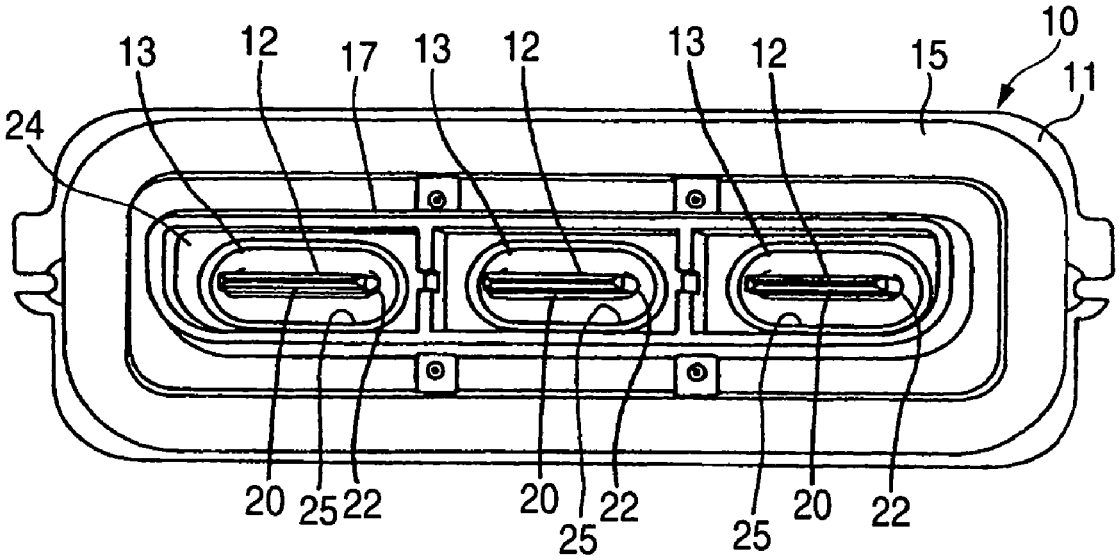
FIG. 5 is a perspective view of the fitting portion of the female connector of FIG. 4 (in which the elastic seal members are mounted) for the male connector as seen obliquely from the lower left side.
Figure 6:
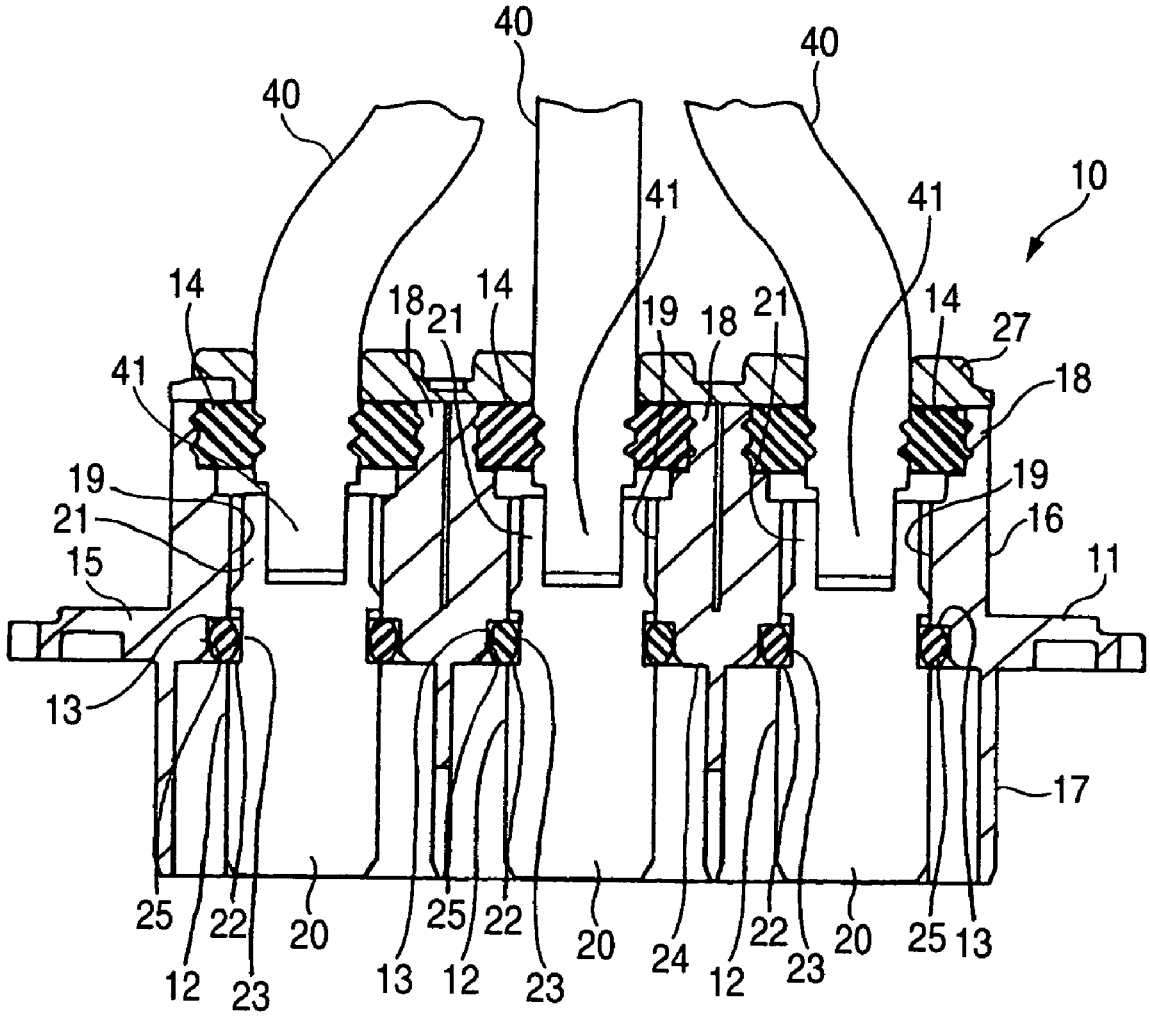
FIG. 6 is a cross-sectional view of the female connector taken along the line VI—VI of FIG. 2.
Figure 7:
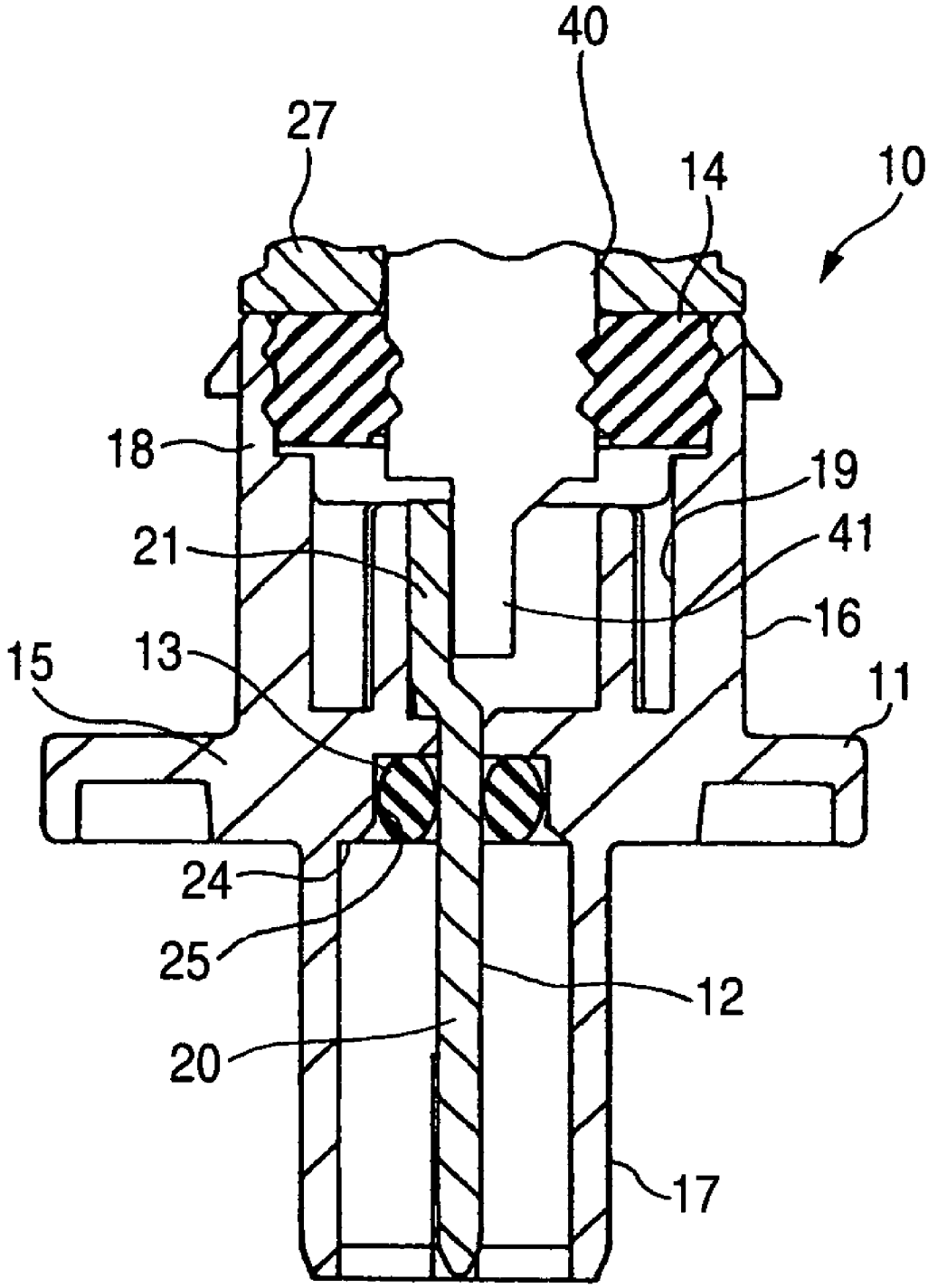
FIG. 7 is a cross-sectional view of the female connector taken along the line VII—VII of FIG. 2.
Figure 8:
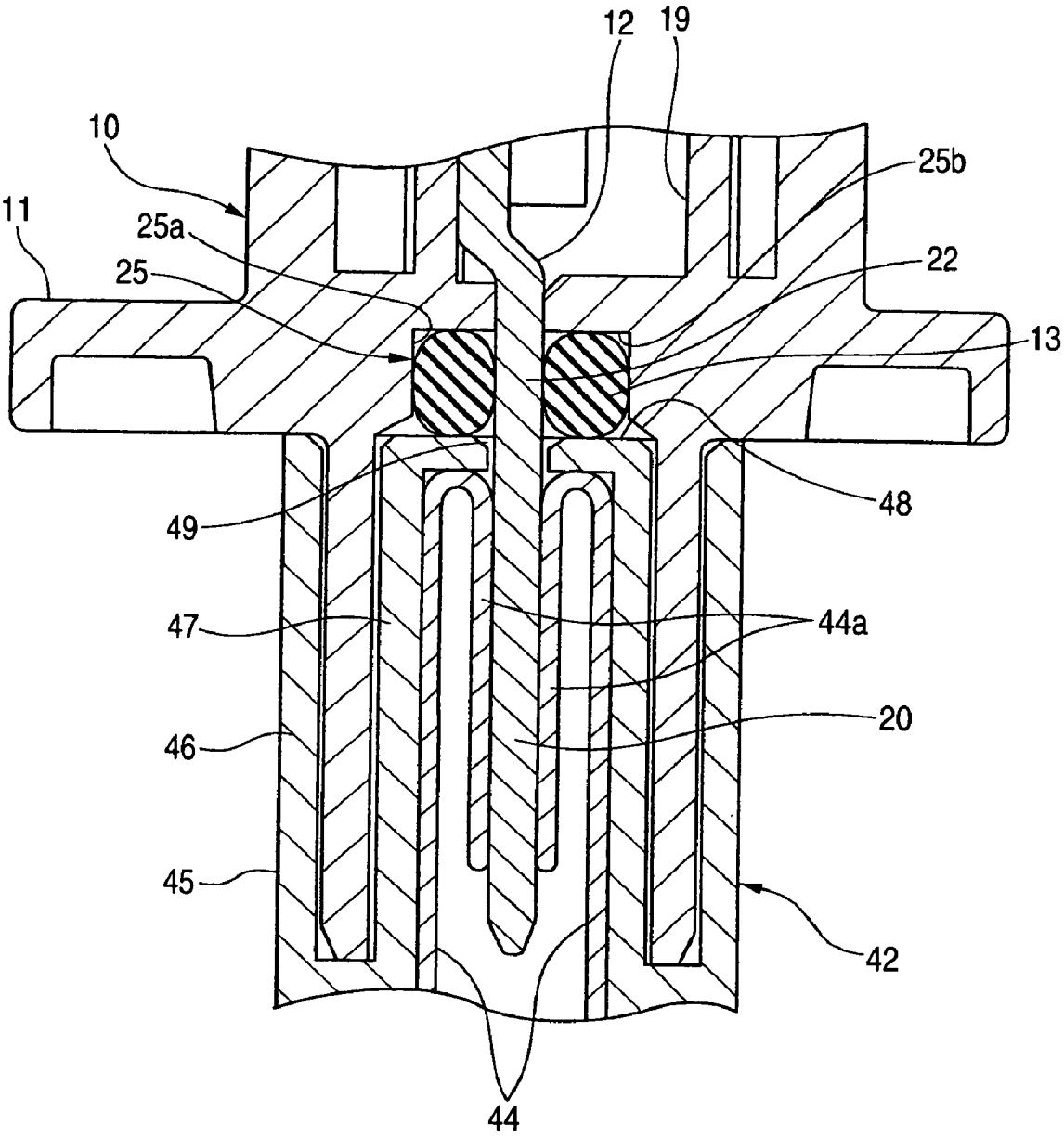
FIG. 8 is a cross-sectional view of an important portion the connector of the above embodiment, showing a condition in which the female and male connectors are completely fitted together.

FIG. 1 is an exploded, perspective view showing the assembling relation between various parts of a female connector of one preferred embodiment of a connector of the invention, FIG. 2 is a perspective view showing a condition immediately before the assembled female connector of FIG. 1 and a male connector are fitted together, FIG. 3A is a perspective view showing a male tab terminal (which is to be received in a male terminal receiving chamber in a connector housing of the female connector of FIG. 1) and a wire connected to the male tab terminal, FIG. 3B is a perspective view showing a condition before an elastic seal member is mounted on the wire-connected male tab terminal of FIG. 3A, FIG. 3C is a perspective view of the wire-connected male tab terminal having the elastic seal member of FIG. 3B mounted thereon, FIG. 4 is a perspective view of a fitting portion of the female connector (in which the elastic seal members are not yet mounted) for the male connector as seen obliquely from the lower left side, FIG. 5 is a perspective view of the fitting portion of the female connector of FIG. 4 (in which the elastic seal members are mounted) for the male connector as seen obliquely from the lower left side, FIG. 6 is a cross-sectional view of the female connector taken along the line VI—VI of FIG. 2, FIG. 7 is a cross-sectional view of the female connector taken along the line VII—VII of FIG. 2, and FIG. 8 is a cross-sectional view of an important portion the connector of the above embodiment, showing a condition in which the female and male connectors are completely fitted together.

As shown in FIGS. 1 to 3, the connector, embodying the invention, comprises the female connector 10, and the male connector 42 for fitting to the female connector 10. The female connector 10 comprises a female connector housing 11, three male tab terminals (flat plate-type male terminals) 12, three O-rings (serving as annular elastic seal members) 13, and three annular waterproof plugs 14.

The female connector housing 11 includes a holder portion 16 formed on an upper surface of a flat plate-like base 15, and a fitting recess portion 17 (serving as the fitting portion for fitting connection to a male connector housing 45 of the male connector 42) formed on a lower surface of the base 15. The fitting recess portion 17 has a rectangular tubular shape. The holder portion 16 has three cylindrical portions 18 arranged radially of one another in continuous relation. The male terminal receiving chamber 19 is formed in a central portion of each of the cylindrical portions 18. The male terminal receiving chamber 19 extends to the fitting recess portion 17 through the cylindrical portion 18, and is continuous with an internal space of the fitting recess portion 17.

Each male tab terminal 12 includes a flat plate-like electrical contact portion 20 (for electrical connection to a female terminal 44) formed at its distal end portion, and a wire connection portion 21 formed at its proximal end portion. The wire connection portion 21 is electrically connected to a conductor 41 of the wire 40, for example, by thermal press-clamping. The male tab terminal 12 further includes an O-ring mounting portion 22 formed between the electrical contact portion 20 and the wire connection portion 21. The O-ring mounting portion 22 has a pair of generally U-shaped grooves 22*a* formed respectively in opposite side edges of a proximal end portion of the flat plate-like electrical contact portion 20 disposed adjacent to the wire connection portion 21. A curved surface portion 23 is formed on a bottom of each of the U-shaped grooves 22*a*.

The O-ring 13 is the elastic seal member which is made of a soft synthetic resin, and is formed into an annular shape. The O-ring 13 is mounted on the O-ring mounting portion 22 of the male tab terminal 12. The O-ring 13, mounted on the O-ring mounting portion 22, is so retained by the U-shaped grooves 22*a* of the O-ring mounting portion 22 that the O-ring 13 will not be much displaced on the O-ring mounting portion 22. And besides, the O-ring 13, mounted on the O-ring mounting portion 22, is held in intimate contact with the curved surface portions 23 of the O-ring mounting portion 22 in a tense condition, and therefore achieves a high sealing performance because of its own elastic restoring force.

The waterproof plug 14 is a lid which is made of a soft synthetic rubber, and is formed into an annular shape. The wire 40 is passed through a central portion of the waterproof plug 14, and the waterproof plug 14 is retained on the wire 40, and in this condition the waterproof plug 14 is fitted into the cylindrical portion 18 of the female connector housing 11, and seals a gap between an inner peripheral surface of the cylindrical portion 18 and an outer peripheral surface of the wire 40. As a result, a liquid such as water and oil is prevented from intruding into the male terminal receiving chamber 19 from that side where the wire 40 is disposed. A silicone filler or the like is not filled in the male terminal receiving chamber 19, and the waterproof plug 14 is mounted in the cylindrical portion.

The male connector housing 45 of the male connector 42 includes a guide plate 46 of a rectangular tubular shape for fitting on the fitting recess portion 17 of the female connector 10, and three fitting projections 47 which are provided within the guide plate 46, and can be fitted into the fitting recess portion 17 of the female connector 10. Three female (female-type) terminals 44 are received within the three fitting projections 47, respectively. The female connector 10 is fitted to the male connector 42 while an outer peripheral wall of the fitting recess portion 17 is inserted between the guide plate 46 and the series of fitting projections 47, and also the male tab terminals 12 are inserted respectively into the female terminals 44.

Nest, a method of mounting the O-ring 13 on the male tab terminal 12 will be described with reference to FIGS. 3A to 3C. Although the O-ring 13 is attached to the male terminal 12 which has already been inserted into the male terminal receiving chamber 19 through the cylindrical portion 18 of the female connector housing 11, and has been held in a retained condition, the showing of the female connector housing 11 and so on is omitted here for better understanding of the method of mounting the O-ring 13 on the male tab terminal 12.

As shown in FIG. 3A, the wire connection portion 21 of the male tab terminal 12 has a U-shaped cross-section, and the conductor 41 of the wire 40 is received in this wire connection portion 21, and is electrically connected thereto.

As shown in FIG. 3B, the O-ring 13 is fitted onto the male tab terminal 12 from the distal end-side of the electrical contact portion 20. At this time, the O-ring 13 is elastically deformed by the electrical contact portion 20 such that its inner hole is enlarged.

As shown in FIG. 3C, the O-ring 13 is moved in a rubbing manner on the electrical contact portion 20 toward the wire connection portion 21, and then is fitted into the O-ring mounting portion 22. In this condition, the O-ring 13 is kept elastically deformed by the O-ring mounting portion 22 such that its inner hole is enlarged, and therefore because of its own elastic restoring force, the O-ring 13 is held in intimate contact with the outer peripheral surface of the O-ring mounting portion 22 in a tense condition over the entire periphery thereof (including the curved surface portions 23).

As shown in FIG. 4, the electrical contact portions 20 of the male tab terminals 12, received respectively in the male terminal receiving chambers 19 in the connector housing 11, project into the interior of the fitting recess portion 17, and are disposed within this fitting recess portion 17. O-ring receiving step portions 25 of an annular shape are formed in that portion of a front wall 24 of the female connector housing 11 disposed within the fitting recess portion 17. Each O-ring receiving step portion 25 has an opening peripheral surface defining an opening of the corresponding male terminal receiving chamber 19 through which the electrical contact portion 20 of the male tab terminal 12 projects outwardly from the male terminal receiving chamber 19. The O-ring receiving step portion 25 is formed in an outer surface of the front wall 24 of the female connector housing 11 to form a step in this outer surface. When the male tab terminal 12 is retained in the male terminal receiving chamber 19, the O-ring mounting portion 22 of the male tab terminal 12 is surrounded by the opening peripheral surface of the O-ring receiving step portion 25.

The O-ring 13 is moved in a rubbing manner on the electrical contact portion 20 of the male tab terminal 12 (which projects into the fitting recess portion 17) toward the wire connection portion 21, and then is fitted into the O-ring mounting portion 22 as shown in FIG. 5, so that the O-ring 13 is fitted in the O-ring receiving step portion 25. In this condition, the O-ring 13 is clamped between the O-ring mounting portion 22 and the opening peripheral surface of the O-ring receiving step portion 25.

As shown in more detail in FIGS. 6, 7 and 8, the O-ring 13, mounted on the O-ring mounting portion 22 of the male tab terminal 12, is fitted in the O-ring receiving step portion 25 in the front wall 24 at that end of the male terminal receiving chamber 19 remote from the wire, so that the O-ring 13 is held in intimate contact with the opening peripheral surface of the O-ring receiving step portion 25 which defines the opening in the front wall 24 (in other words, the opening of the male terminal receiving chamber 19). Namely, the O-ring 13 is held in intimate contact with the outer peripheral surface of the O-ring mounting portion 22 of the male tab terminal 12 over the entire periphery thereof, and also is mainly held in intimate contact with a first peripheral surface 25*a* of the opening peripheral surface of the O-ring receiving step portion 25 over an entire periphery thereof, the first peripheral surface 25*a* extending in a direction parallel to the direction of extending of the electrical contact portion 20 of the male tab terminal 12. Therefore, the O-ring 13 prevents a liquid such as water and oil from intruding into the male terminal receiving chamber 19 from that side where the fitting recess portion 17 is disposed. The O-ring 13 is mounted on the outer peripheral surface of the male tab terminal 12, and therefore even when a stress acts on the male tab terminal 12, the O-ring 13 absorbs this stress, and supports the male terminal 12 in a stable manner.

A cover 27 is attached to the female connector housing 11, and this cover 27 holds rear surfaces of the waterproof plugs 14, thereby preventing the waterproof plugs 14 from being withdrawn rearwardly from the female connector housing 11. As is clear from FIG. 7, that portion of the male tab terminal 12, lying between the wire connection portion 21 and the electrical contact portion 20, is bent to form a step portion, and this step portion is retainingly engaged with the front wall 24 (in other words, an inner wall of the male terminal receiving chamber 19).

As shown in more detail in FIG. 8, when the female connector 10 and the male connector 42 are fitted together, the O-ring 13 is directly clamped between a second peripheral surface 25*b* of the opening peripheral surface of the O-ring receiving step portion 25 (which is disposed close to the male terminal receiving chamber 19, and intersects the direction of extending of the electrical contact portion 20 of the male tab terminal 12) and a portion 48 of a front surface (with respect to the fitting direction) of the fitting projection 47 of the male connector housing 45 in the direction of fitting of the female connector 10 and the male connector 20, and are pressed by the second peripheral surface 25*b* and the portion 48. This portion 48 is disposed around a male terminal insertion port 49 (which allows an electrical contact portion 44*a* of the female terminal 44 and the electrical contact portion 20 of the male tab terminal 12 to contact each other) formed in the front surface of the fitting projection 47. The fitted condition of the female and male connectors 10 and 42 is maintained by a fitted condition-holding mechanism including a plurality of fitting holding arms F each with a retaining projection P (see FIG. 2) and engagement holes (not shown) for engagement with the retaining projections P.

The construction of the preferred embodiment of the connector of the invention will be described briefly in the following.

The preferred embodiment of the connector of the invention comprises the female connector 10, and the male connector 42 for fitting to the female connector 10, and the female connector 10 including:

the female connector housing 11;

the male terminal receiving chambers 19 formed in the female connector housing 11;

the male tab terminals 12 each including the wire connection portion 21 for electrical connection to the wire 40, and the electrical contact portion 20 which is electrically connected to the female terminal 44 of the male connector 42 when the female connector 10 and the male connector 42 are fitted together, the male tab terminals 12 being received respectively in the male terminal receiving chambers 19 such that the electrical contact portion 20 of each male tab terminal 12 projects outwardly from the male terminal receiving chamber 19 through the opening of the male terminal receiving chamber 19;

the O-ring receiving step portions 25 each of which is formed in the female connector housing 11, and has the opening peripheral surface defining the opening of the male terminal receiving chamber 19;

the O-ring mounting portions 22 each of which is formed between the wire connection portion 21 and the electrical contact portion 20 of the corresponding male tab terminal 12, and is surrounded by the opening peripheral surface of the corresponding O-ring receiving step portion 25; and the rubber-made O-rings 13 each of which is clamped between the corresponding O-ring mounting portion 22 and the opening peripheral surface (particularly, the first peripheral surface 25*a*) of the corresponding O-ring receiving step portion 25.

The O-ring 13 is held in intimate contact with the outer peripheral surface of the O-ring mounting portion 22 over the entire periphery thereof, and also is held in intimate contact with the first peripheral surface 25*a* of the O-ring receiving step portion 25 over the entire periphery thereof, and when the female connector 10 and the male connector 42 are fitted together, the O-ring 13 is directly clamped between the female connector housing 11 and the male connector housing 45 in the direction of fitting of the female and male connectors 10 and 42, and is pressed by the two connector housings 11 and 45.

The term "the O-ring 13 is held in intimate contact with the outer peripheral surface of the O-ring mounting portion 22 over the entire periphery thereof" means that the O-ring 13 extends completely around the outer peripheral surface of the O-ring mounting portion 22, but the O-ring 13 may or may not be held in intimate contact with the outer peripheral surface of the O-ring mounting portion 22 over the entire area thereof. Similarly, the term "the O-ring 13 is held in intimate contact with the first peripheral surface 25*a* of the O-ring receiving step portion 25 over the entire periphery thereof" means that the O-ring 13 extends completely along the first peripheral surface 25*a* of the O-ring receiving step portion 25, but the O-ring 13 may or may not be held in intimate contact with the first peripheral surface 25*a* of the O-ring receiving step portion 25 over the entire area thereof. Naturally, it is preferred that the area of intimate contact of the O-ring 13 with the outer peripheral surface of the O-ring mounting portion 22, as well as the area of intimate contact of the O-ring 13 with the first peripheral surface 25*a* of the O-ring receiving step portion 25, be larger.

When the female connector 10 and the male connector 42 are fitted together, the O-ring 13 is directly pressed by the second peripheral surface 25*b* of the opening peripheral surface of the O-ring receiving step portion 25 (which is disposed close to the male terminal receiving chamber 19, and intersects the direction of extending of the electrical contact portion 20 of the male tab terminal 12) and the portion 48 of the front surface (with respect to the fitting direction) of the male connector housing 45, and this portion 48 is disposed around the male terminal insertion port 49 (which allows the female terminal 44 and the electrical contact portion 20 of the male tab terminal 12 to contact each other) formed in the front surface of the male connector housing 45.

The outer peripheral surface of the O-ring mounting portion 22 has the curved surface portions 23. The O-ring mounting portion 22 has the generally U-shaped grooves 22*a*, and the O-ring 13 is fitted in the U-shaped grooves 22*a*, and is retained by these grooves. Preferably, the bottom surface of the U-shaped groove 22*a* in the O-ring mounting portion 22 defines the curved surface portion 23.

The female connector 10 further includes the waterproof plugs 14 each of which is disposed between the wire 40, connected to the wire connection portion 21 of the male tab terminal 12, and the female connector housing 11, and the waterproof plug 14 and the O-ring 13 cooperate with each other to make the male terminal receiving chamber 19 watertight.

As described above, in the connector of the above embodiment, the O-ring 13 is held in intimate contact with the outer peripheral surface of the O-ring mounting portion 22 of the male tab terminal 12 over the entire periphery thereof, and also is held in intimate contact with the opening peripheral surface of the O-ring receiving step portion 25 of the female connector housing 11 over the entire periphery thereof, and when the female connector 10 and the male connector 42 are fitted together, the O-ring 13 is directly clamped between the female connector housing 11 and the male connector housing 45 in the direction of fitting of the female and male connectors 10 and 42, and is pressed by the two connector housings 11 and 45. Therefore, unlike the type of liquid intrusion prevention structure in which the O-ring 13 is mounted on the male tab terminal 12, and is merely clamped between the male tab terminal 12 and the female connector housing 11, the liquid intrusion prevention structure of the above embodiment is such that the O-ring 13 is pressed by the female connector housing 11 and the male connector housing 45 in the direction of fitting of the female and male connectors 10 and 42, so that the degree of intimate contact of the O-ring 13 with the outer peripheral surface of the O-ring mounting portion 22 of the male tab terminal 12, as well as the degree of intimate contact of the O-ring 13 with the opening peripheral surface of the O-ring receiving step portion 25, is enhanced. Therefore, the O-ring 13 positively prevents a liquid such as water and oil from intruding into the male terminal receiving chamber 19 from that side where the electrical contact portion 20 of the male tab terminal 12 is disposed. Thus, the degree of intimate contact of the O-ring 13 with the outer peripheral surface of the O-ring mounting portion 22 of the male tab terminal 12, as well as the degree of intimate contact of the O-ring 13 with the opening peripheral surface of the O-ring receiving step portion 25, is enhanced by the elastic deformation of the O-ring 13 in the fitting direction which is caused by the pressing of the female and male connector housings 11 and 45 against the O-ring 13. Therefore, adverse effects on the terminal shaking prevention performance and the liquid intrusion prevention performance due to aged deterioration of the O-ring 13 can be reduced.

In the connector of the above embodiment, when the female connector 10 and the male connector 42 are fitted together, the O-ring 13 is directly pressed by the second peripheral surface 25*b* of the opening peripheral surface of the O-ring receiving step portion 25 (which is disposed close to the male terminal receiving chamber 19, and intersects the direction of extending of the electrical contact portion 20 of the male tab terminal 12) and the portion 48 of the front surface (with respect to the fitting direction) of the male connector housing 45, and this portion 48 is disposed around the male terminal insertion port 49 (which allows the female terminal 44 and the electrical contact portion 20 of the male tab terminal 12 to contact each other) formed in the front surface of the male connector housing 45. Therefore, the O-ring 13 also positively prevents a liquid such as water and oil from intruding into the male connector housing 45 through the male terminal insertion port 49. And besides, the O-ring 13 is exposed to the exterior of the female connector housing 11 through the front side thereof, and is disposed in such a position that the O-ring 13 can be brought into contact with the male connector housing 45 when the female connector housing 11 is fitted to the male connector housing 45. Therefore, the O-ring 13 can be easily mounted on the O-ring mounting portion 22 from the electrical contact portion (20) side of the male tab terminal 12, and therefore the liquid intrusion prevention structure can be easily assembled.

In the connector of the above embodiment, the O-ring 13 can be held in intimate contact with the curved surface portions 23 of the O-ring mounting portion 22 in a tense condition as compared with the case where edges (or corners) are formed on the O-ring mounting portion 22. And besides, the O-ring is protected from damage by such edges. Thus, the O-ring mounting portion 22 is not a flat plate-shaped portion having four corners or such a portion whose four corners are merely chamfered, but has the curved surfaces, and therefore achieves the excellent advantageous effects.

In the connector of the above embodiment, the O-ring 13 is fitted in the U-shaped grooves 22*a* in the O-ring mounting portion 22, and is retained by these grooves. Therefore, the O-ring will not be disengaged from the O-ring mounting portion 22, and also will not be displaced out of position. The O-ring 13 is made of the soft synthetic resin, and is formed into the annular shape, and the O-ring 13 performs the sealing function by its elastic restoring force produced when it is gripped and squeezed.

In the connector of the above embodiment, the waterproof plug 14 prevents a liquid such as water and oil from intruding into the male terminal receiving chamber 19 from that side where the wire 40 is disposed.

The present invention is not limited to the above embodiment, and suitable modifications, improvements and so on can be made. The material, shape, dimensions, numerical values, form, number, disposition, etc., of each of the constituent elements of the above embodiment are arbitrary, and are not limited in so far as the invention can be achieved.

For example, in the connector of the above embodiment, although the flat plate-like male terminals (that is, the male tab terminals) are adopted, the male terminals are not limited to this type, and male terminals each having a cylindrical electrical contact portion can be used, in which case also excellent operational effects and advantages are achieved similarly.

Figure 9:
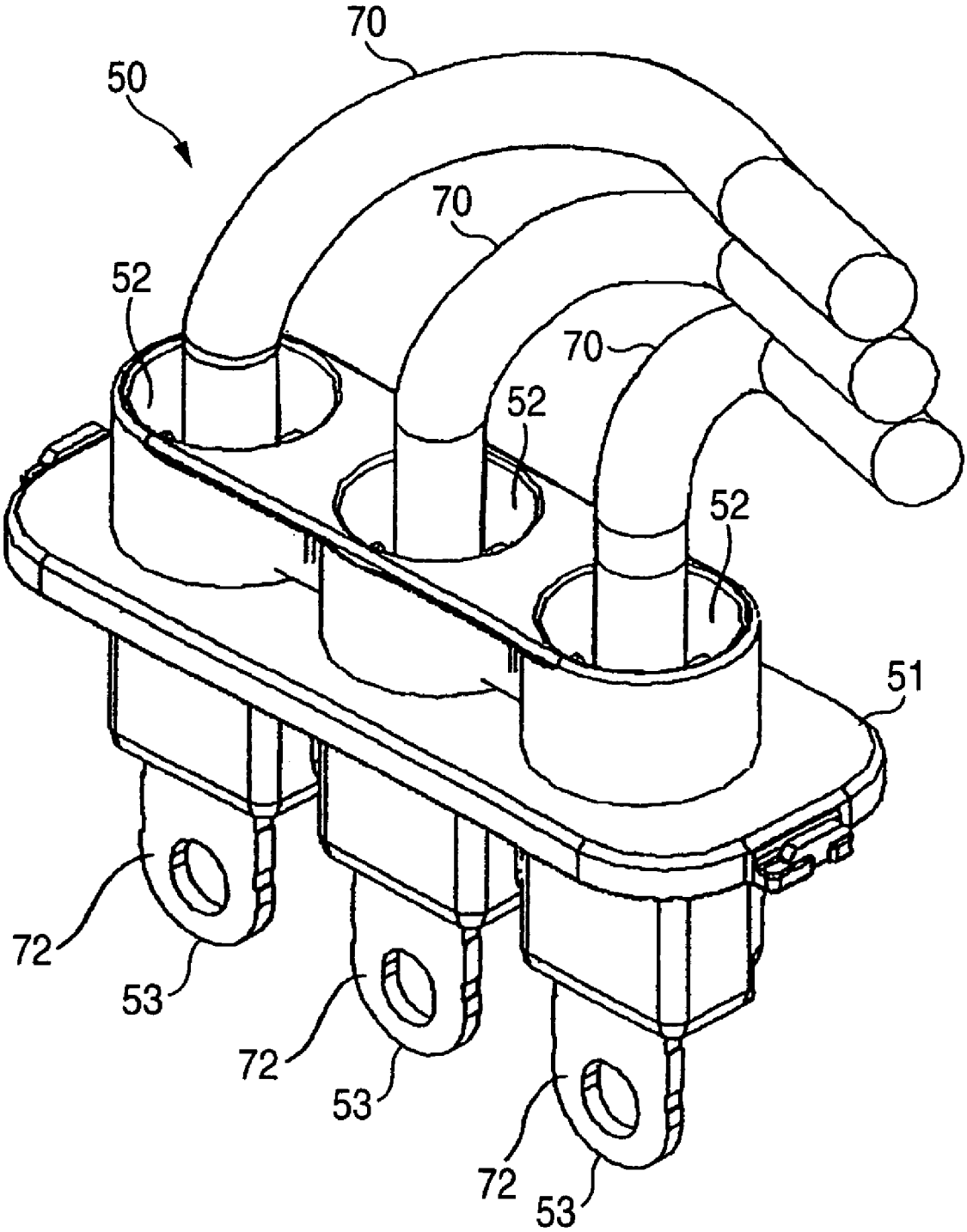
FIG. 9 is a perspective view of a conventional connector, showing a condition before waterproof rubber plugs are mounted therein.
Figure 10:
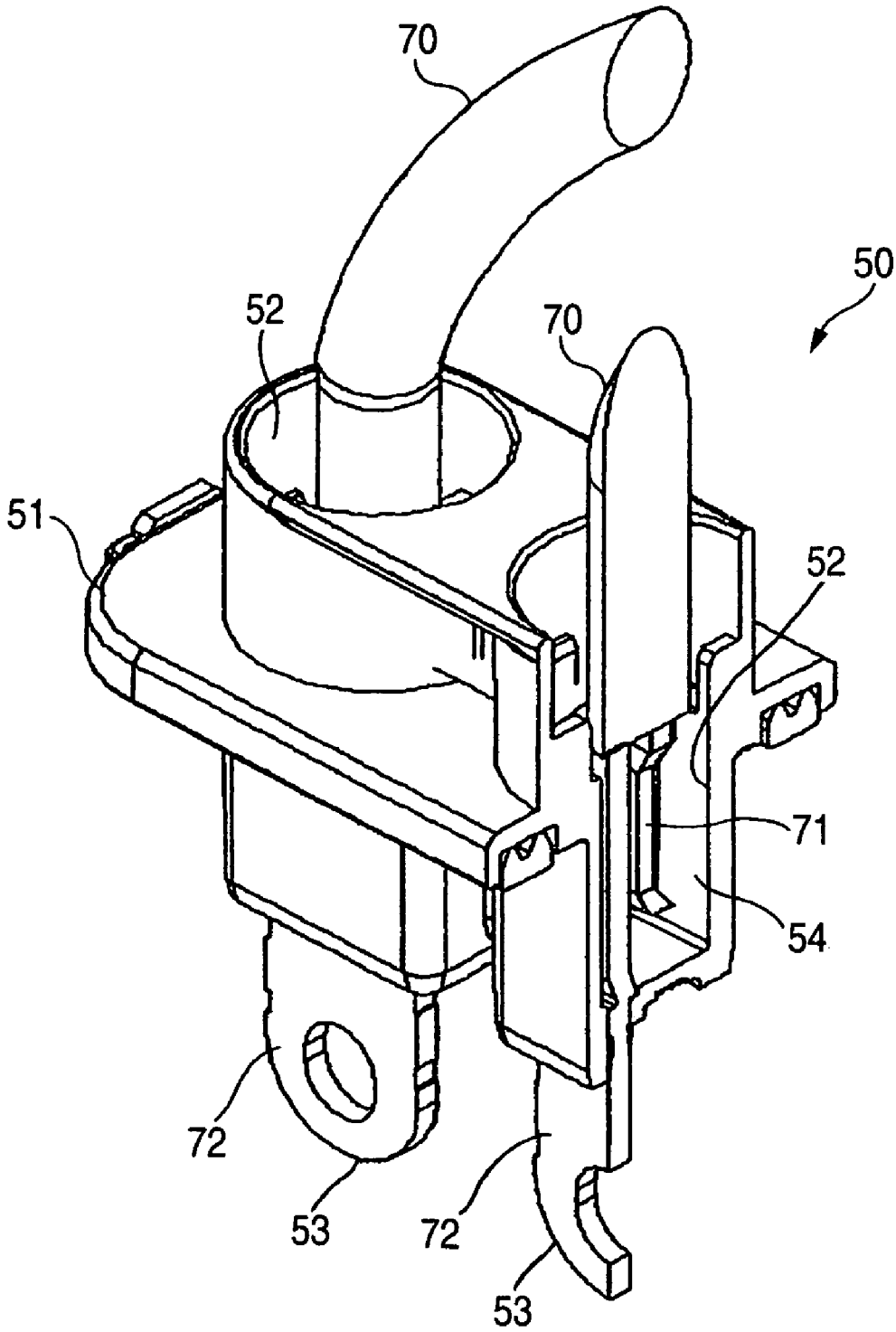
FIG. 10 is a cross-sectional view of the connector of FIG. 9.
Figure 11:
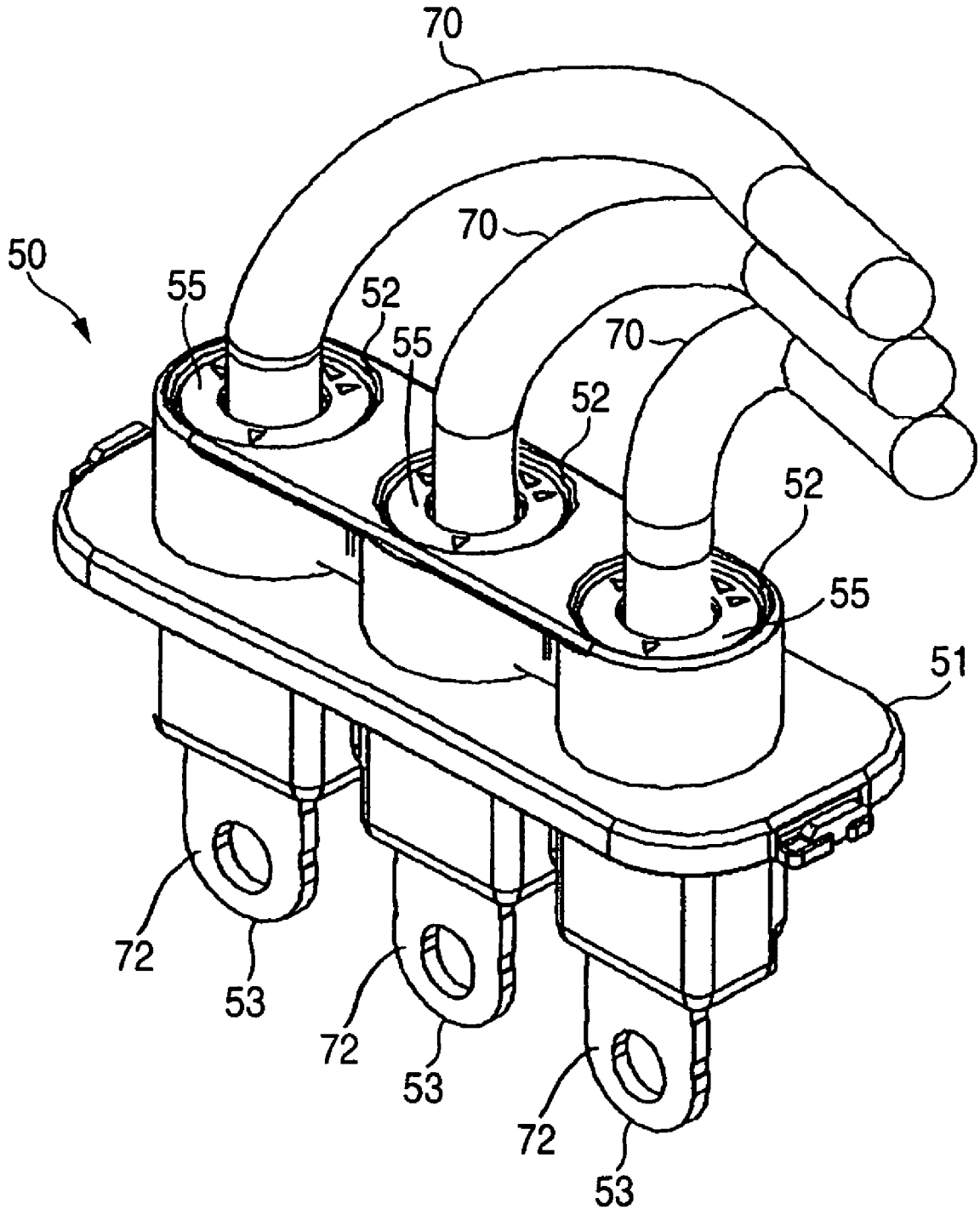
FIG. 11 is a perspective view of the connector of FIG. 9, showing a condition after the waterproof rubber plugs are mounted therein.

In the connector of the above embodiment, although there are adopted the female connector, including the female connector housing receiving the male terminals, and the male connector which can be fitted to the female connector, and includes the male connector housing receiving the female terminals, the connector is not limited to this construction. For example, there can adopted a male connector, including a male connector housing receiving male terminals, and a female connector which can be fitted to the male connector, and includes a female connector housing receiving female terminals as shown in FIGS. 9 to 11, in which case also excellent operational effects and advantages are achieved similarly.

What is claimed is:

1. A connector comprising a female connector, and a male connector for fitting to said female connector, one of said female and male connectors including:

a connector housing;

a male terminal receiving chamber formed in said connector housing;

a male terminal including a wire connection portion for electrical connection to a wire, and an electrical contact portion which is electrically connected to a female terminal in another of said female and male connectors when said female and male connectors are fitted together, said male terminal being received in said male terminal receiving chamber such that said electrical contact portion of said male terminal projects outwardly from said male terminal receiving chamber through an opening of said male terminal receiving chamber;

a receiving step portion which is formed in said connector housing, and has an opening peripheral surface defining said opening;

a mounting portion which is formed on said male terminal, and is disposed between said wire connection portion and said electrical contact portion, and is surrounded by the opening peripheral surface of said receiving step portion; and an annular elastic seal member which is clamped between said mounting portion of said male terminal and the opening peripheral surface of said receiving step portion; and wherein said elastic seal member is held in intimate contact with an outer peripheral surface of said mounting portion over an entire periphery thereof, and is held in intimate contact with the opening peripheral surface of said receiving step portion over an entire periphery thereof, and when said female connector and said male connector are fitted together, said elastic seal member is directly clamped between said connector housing and a connector housing of said another connector, receiving said female terminal, in a direction of fitting of said female and male connectors, and is pressed by said two connector housings.

2. A connector according to claim 1, wherein when said female connector and said male connector are fitted together, said elastic seal member is directly pressed by a peripheral surface of the opening peripheral surface of said receiving step portion, which is disposed close to said male terminal receiving chamber, and intersects a direction of extending of said electrical contact portion of said male terminal and a portion of a front surface with respect to the fitting direction of said connector housing of said another connector, which is disposed around a male terminal insertion port which allows said female terminal and said electrical contact portion of said male terminal to contact each other formed.

3. A connector according to claim 1, wherein the outer peripheral surface of said mounting portion has curved surface portions.

4. A connector according to claim 1, wherein said mounting portion has generally U-shaped grooves, and said elastic seal member is fitted in said U-shaped grooves, and is retained by said grooves.

5. A connector according to claim 4, wherein a bottom surface of each of said U-shaped grooves in said mounting portion defines said curved surface portion.

6. A connector according to claim 1, wherein said elastic seal member is an O-ring made of rubber.

7. A connector according to claim 1, wherein a waterproof plug is disposed between the wire, connected to said wire connection portion of said male terminal, and said connector housing of said one connector, and said waterproof plug and said elastic seal member cooperate with each other to make said male terminal receiving chamber watertight.

* * * * *